US006024037A

United States Patent [19]

Yoshida et al.

[11] Patent Number: 6,024,037

[45] Date of Patent: Feb. 15, 2000

[54] PROGRAMMABLE ELECTRONIC SEWING MACHINE

[75] Inventors: Shinji Yoshida, Nagoya; Kazushi Inoue, Aichi-gun; Yoshihiro Hara, Kasugai; Minoru Yamaguchi, Kariya, all of Japan

[73] Assignee: Brother Kogyo Kabushiki Kaisha, Nagoya, Japan

[21] Appl. No.: 09/084,214

[22] Filed: May 26, 1998

[30] Foreign Application Priority Data

May 26, 1997 [JP] Japan ..... 9-135533

[51] Int. Cl.[7] ..... D05B 19/08

[52] U.S. Cl. ..... 112/470.04; 112/457

[58] Field of Search ..... 112/470.04, 470.06, 112/102.5, 453, 454, 456, 457, 458; 364/470.09, 470.01

[56] References Cited

U.S. PATENT DOCUMENTS

| | | | |
|---|---|---|---|
| 4,092,938 | 6/1978 | Coughenour et al. | 112/457 |
| 4,323,022 | 4/1982 | Hanyu et al. | 112/458 X |
| 4,648,341 | 3/1987 | Kato et al. | 112/458 |

*Primary Examiner*—Peter Nerbun
*Attorney, Agent, or Firm*—Oliff & Berridge, PLC

[57] ABSTRACT

A programmable electronic sewing machine includes input means for supplying input data when operated by a user, and sewing program composing means for composing a sewing program for the sewing machine on the basis of the input data supplied from the input means. The sewing program composing means composes the same sewing program on the basis of the input data supplied from the input means when the input means is operated in two or more different operating procedures.

15 Claims, 8 Drawing Sheets

PROGRAMMABLE ELECTRONIC SEWING MACHINE

BACKGROUND OF THE INVENTION

1. Field of the Invention

This invention relates to a programmable electronic sewing machine of the pattern seamer type in which a cloth feeding mechanism and a needle driving mechanism are operated according to a sewing program so that a sewing operation is executed.

2. Description of the Related Art

Conventional programmable electronic sewing machines of the above-described type are mainly provided with two operation modes, namely, a sewing mode for execution of a sewing operation and a program composing mode for composition of a sewing program. In the program composing mode, for example, a user designates various conditions required for specifying a sewing route using a key input device etc. The sewing program is composed on the basis of the designated conditions. These conditions include a seam pattern, e.g., straight stitch, curved stitch or zigzag stitch, needle locations, e.g., sewing start point, sewing end point, and intermediate points between the sewing start and end points, if necessary, and a stitch pitch. When these conditions are designated, a sewing route from the sewing start point to the sewing end point can be specified.

An operating procedure for composition of the sewing program is sometimes changed for the purpose of improvement in the operability when new models of the above-described programmable electronic sewing machines replace old models. When a user, who uses the sewing machine of the above-described type for the first time, gets a new model, he or she finds the sewing machine convenient because its operability has been improved. However, when another user who was using the old model gets a new model, he or she is obliged to learn the changed operating procedure. This poses a problem. Furthermore, the user sometimes inadvertently applies an operating procedure for the old model to the new model before he or she gets accustomed to one for the new model. Thus, the new model takes the user much time and accordingly, its operability is degraded.

SUMMARY OF THE INVENTION

Therefore, an object of the present invention is to provide a programmable electronic sewing machine which has such an improved operability that the user can select a most convenient operating procedure in the composition of the sewing program.

In one aspect, the present invention provides a programmable electronic sewing machine comprising input means for supplying input data when operated by a user, and sewing program composing means for composing a sewing program for the machine on the basis of the input data supplied from the input means, the sewing program composing means composing the same sewing program on the basis of the input data supplied from the input means when the input means is operated in two or more different operating procedures.

According to the above-described sewing machine, a sewing program is composed by the sewing program composing means on the basis of input data supplied in one operating procedure. The same sewing program is composed by the sewing program composing means on the basis of input data supplied in the other operating procedure differing from said one operating procedure. The user can optionally select either one of the operating procedures based on which the sewing program composing means composes the sewing program. The same sewing program is composed when either operating procedure is selected.

For example, a first operating procedure may be employed as that for a new model of the sewing machine, and a second operating procedure may be employed as the same procedure provided for an old model of the sewing machine. A user using this type of sewing machine for the first time can compose the sewing program in the first operating procedure providing the improved operability. On the other hand, another user having used the old model of sewing machine can compose the sewing program in the second operating procedure and accordingly need not learn the new operating procedure. Consequently, the operability of the sewing machine can be improved to a large extent.

In a preferred form, the sewing machine further comprises displaying means, and the sewing program composing means includes command method program composing means for composing the sewing program on the basis of a command when the command is supplied thereto from the input means, the command being constituted by characters arranged according to a predetermined rule, and menu method program composing means for composing the sewing program on the basis of selected one or more of optionally selectable items displayed on a screen of the displaying means, and wherein the same sewing program is composed by the command method program composing means and the menu method program composing means. In this arrangement, the menu method program composing means preferably operates the displaying means so that patterns representative of the selectable items are displayed on the screen of the displaying means.

In another aspect, the invention provides a sewing program composing device comprising input means for supplying input data when operated by a user, and sewing program composing means for composing a sewing program for a programmable electronic sewing machine on the basis of the input data supplied from the input means, the sewing program composing means composing the same sewing program on the basis of the input data supplied from the input means when the input means is operated in two or more different operating procedures.

In the above-described sewing program composing device, too, the sewing program composing means preferably includes the command method program composing means and the menu method program composing means. Furthermore, the menu method program composing means also operates the displaying means so that patterns representative of the selectable items are displayed an the screen of the displaying means.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENT

Figure 1:
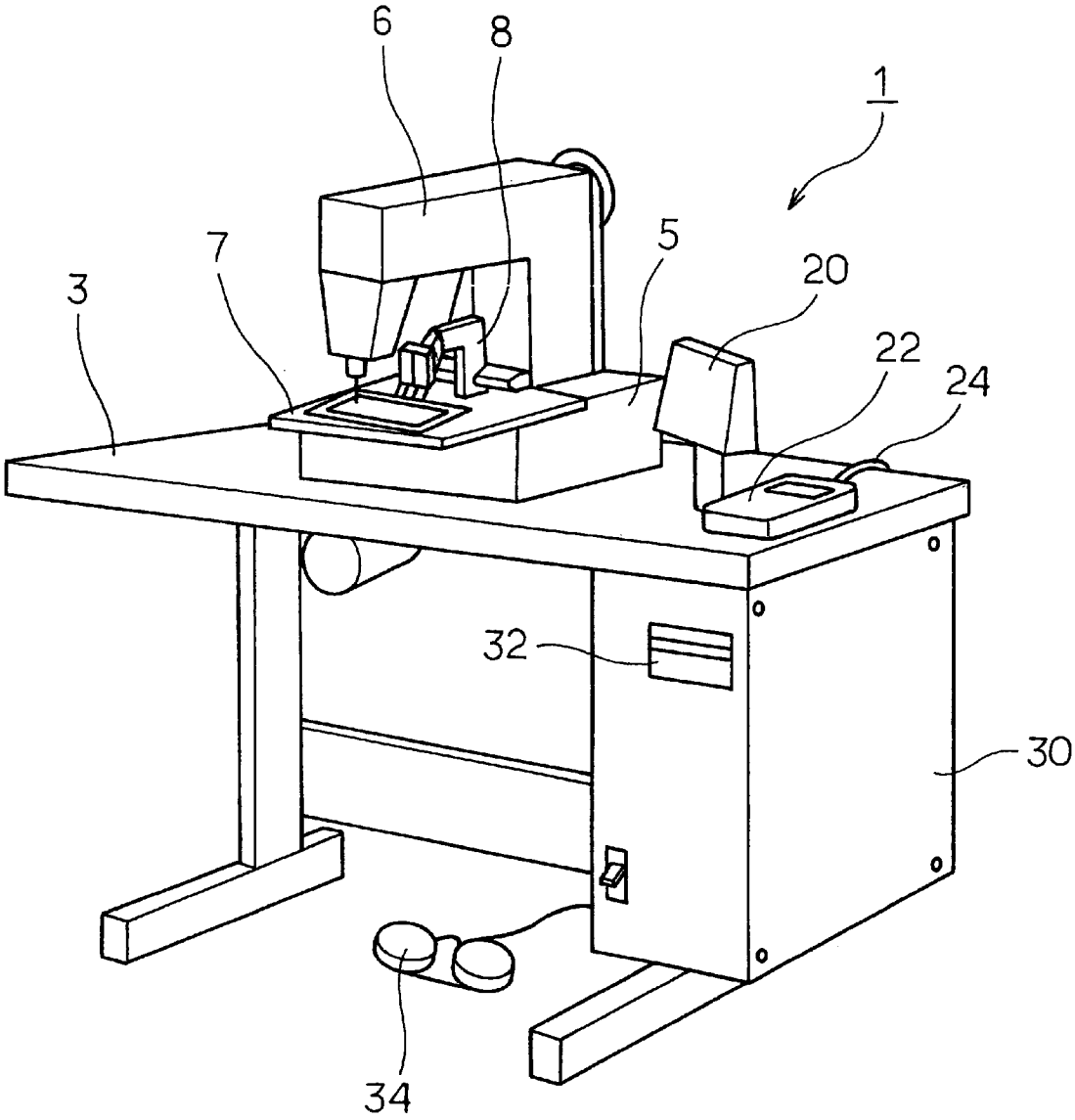
FIG. 1 is a perspective view of a programmable electronic sewing machine of one embodiment in accordance with the present invention.

One embodiment of the present invention will be described with reference to the drawings. Referring to FIG. 1, the programmable electronic sewing machine 1 of the embodiment is shown. The sewing machine 1 includes a sewing table 3, a sewing bed 5 mounted on an upper face of the sewing table 3, and an arm 6 extending vertically from the rear of the sewing bed 5 and then horizontally frontward. A needle plate 7 is fixed on the front upper face of the sewing bed 5.

Figure 2:
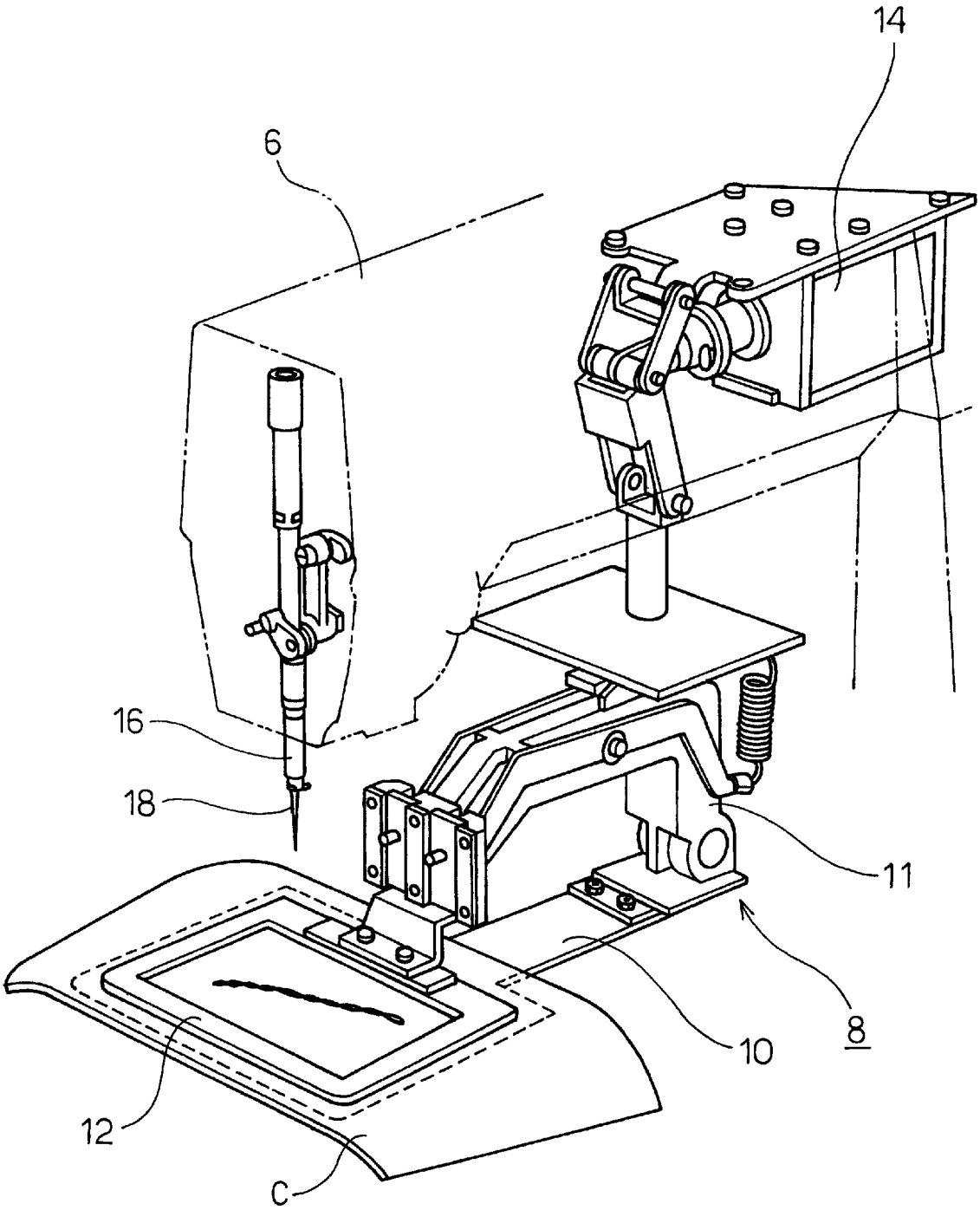
FIG. 2 is a perspective view of a cloth presser of the sewing machine.

A cloth presser 8 is provided over the needle plate 7. The cloth presser 8 moves a workpiece cloth C forward, rearward, leftward and rightward, holding the same. As shown in FIG. 2, the cloth presser 8 includes a feed plate 10 moved forward, rearward, leftward and rightward on the needle plate 7, a presser arm 11 provided on the feed plate 10, and a cloth presser plate 12 mounted an a front end of the presser arm 11 for vertical movement. The cloth presser plate 12 is usually urged upward by a spring (not shown) so as to assume its upper position, at which position the plate 12 is away from the feed plate 10. When urged downward by a presser solenoid 14 mounted on the arm 6, the cloth presser plate 12 is lowered to come into contact with the feed plate 10, so that the cloth C is held between the feed plate 10 and the cloth presser plate 12. A needle bar 16 is mounted on the front of the arm 6 so as to be moved vertically reciprocally. The needle bar 16 is driven by a needle bar driving mechanism (not shown). A sewing needle 18 is attached to a lower end of the needle bar 16.

Figure 3:
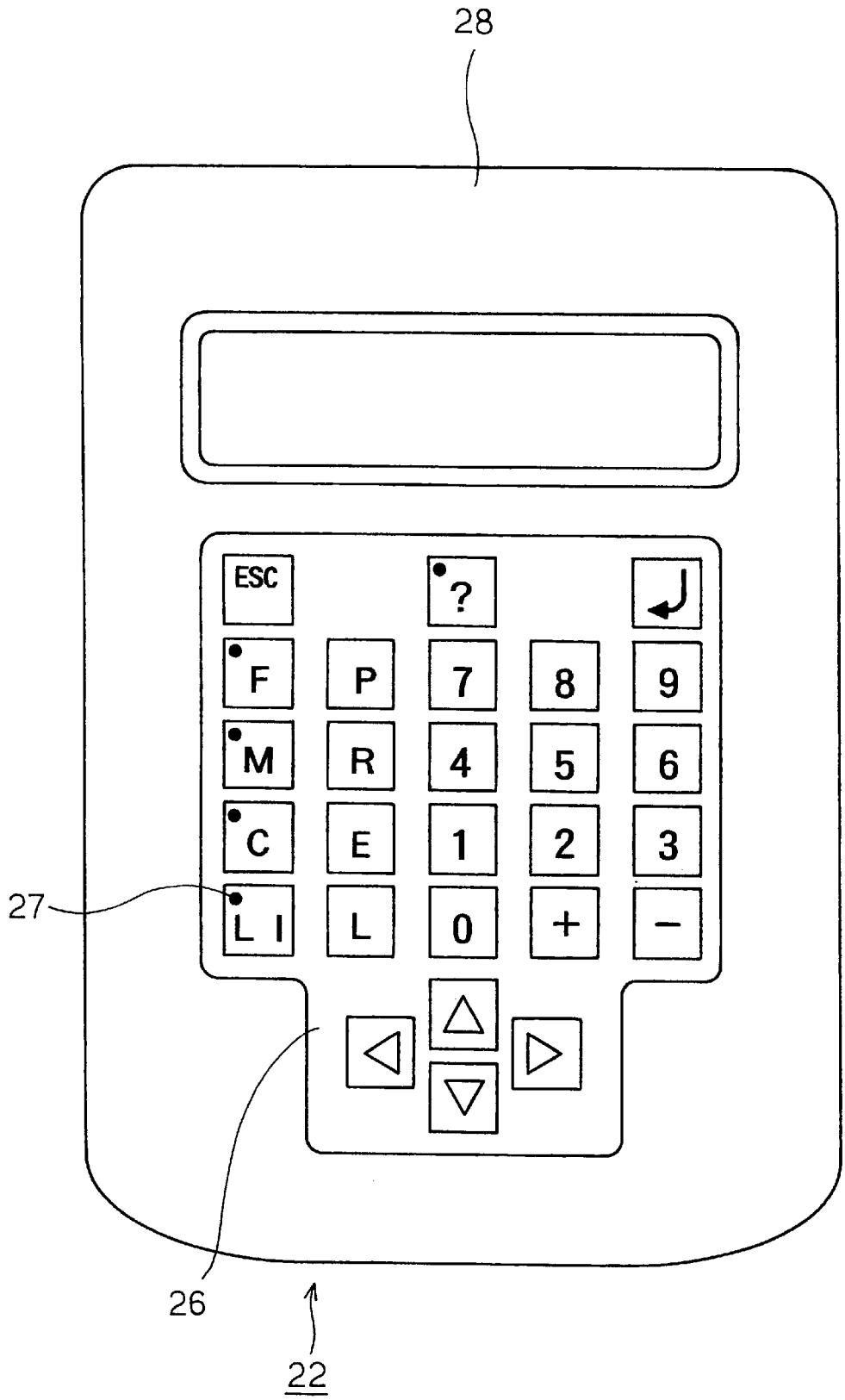
FIG. 3 is a front view of a programmer provided in the sewing machine.

The sewing table 3 constitutes the body of the sewing machine 1. An operation panel 20 operated by a user stands on the upper face of the sewing table 3 on the right of the bed 5, as shown in FIG. 1. The operation panel 20 includes various operation keys and a display, none of which are shown. The operation panel 20 is fixed to the sewing machine 1 and operated when various operation commands are supplied to the sewing machine 1, A programmer 22 separate from the operation panel 20 is detachably connected via a cable 24 to the sewing machine 1. The programmer 22 is also operated by the user. The programmer 22 can be detached from the sewing machine 1 and attached to another sewing machine. The programmer 22 is operated mainly in relation with composition and edit of a sewing program. As shown in FIG. 3, the programmer 22 includes an operation section 26 constituted by a key input device having a number of keys and a liquid crystal display (LCD) 28 of the dot matrix type. The keys of the operation section 26 include "?," "F," "M," "C," and "LI" keys having LEDs 27 provided on the upper left corners thereof respectively. Each LED 27 is turned on when the corresponding key is operable. The LCD 28 displays an image of 60 dots by 248 dots in its maximum. Characters and figures are displayed on a screen of the LCD 28. The programmer 22 constitutes a portable operation box in the invention.

Returning now to FIG. 1, a box 30 enclosing a control device of the sewing machine 1 etc. is mounted on the right-hand backside of the table 3. The box 30 is also provided with a flexible disk drive unit (FDD) 32 so that the sewing program composed by the user is recorded and stared on a magnetic recording medium such as a flexible disk. A pedal switch 34 is provided below the table 3 for switching between start and end of the sewing operation and between raise and lowering of the cloth presser plate 12.

The control system of the sewing machine 1 will be described with reference to FIG. 4. The control system of the sewing machine 1 includes two control systems 40 and 60 independent of each other. The control systems 40 and 60 intercommunicate with each other.

The control system 40 is provided for controlling the overall sewing machine 1 except the programmer 22 or the sewing machine body side. The control system 40 includes a well known CPU 41, a ROM 42, a RAM 43, an operation section 45, an LED 47, a communication section 50, a buzzer 52, an X-axis motor 54, a Y-axis motor 55, a sewing machine motor 56, and the FDD 32. The CPU 41 controls the overall operation of the sewing machine 1. The ROM 42 stores various control programs executed by the CPU 41. The RAM 43 temporally stores various data during operation of the CPU 41. The RAM 43 provides a storage area for storing the sewing program. The CPU 41 refers to the sewing program stored in the RAM 43 during the sewing operation to execute sewing processes. The operation section 45 comprises a key input device (not shown) having a number of operation keys and is provided on the operation panel 20. The LED 47 is provided on the operation panel 20 for displaying various status and caution. The buzzer 52 is provided for informing the user of information about the operation under execution, information about error, etc. The X-axis and Y-axis motors 54 and 55 are provided for moving the cloth presser 8 (see FIG. 2) leftward and rightward, and forward and rearward respectively. The sewing machine motor 56 drives a sewing mechanism comprising the needle bar 16, a shuttle (not shown), etc.

The other control system 60 is provided for controlling the programmer 22. The control system 60 includes a well known CPU 61, a ROM 62, a RAM 63, the operation section 26, the LED 27, a communication section 70, a buzzer 72, the LCD 28, and a back light 75. The CPU 61 controls the overall operation of the programmer 22. The ROM 62 stores various control programs executed by the CPU 61. The RAM 63 temporally stores various data during the operation of the CPU 61. The RAM 63 also has a storage area for storing the sewing program. The CPU 61 receives via the communication section 70 the sewing program transferred from the control system 40 at the machine body side, storing the program in the RAM 63. Furthermore, the CPU 61 reads out the sewing program from the RAM 63 to transfer the program via the communication section 70 to the control system 40. The sewing processes are executed without reference to the sewing program stored in the RAM 63. Power is supplied to the RAM 63 from a back-up power source (not shown) even when a power switch for the programmer 22 is turned off, so that the sewing program stored in the RAM 63 can be prevented from being lost when the power switch for the programmer 22 is turned off. The buzzer 72 is activated to inform information about the operation under execution and information about error by means of sound. The back light 75 irradiates light onto the LCD 28 from behind.

The communication sections 50 and 70 serve as interface devices for serial transmission of data between the control systems 40 and 60. For this purpose, the cable 24 connects between the communication sections 50 and 70.

The ROM 42, the RAM 43 and the communication section 50 are directly connected via buses to the CPU 41. The operation section 45, the LED 47, the buzzer 52, the X-axis motor 54, the Y-axis motor 55, the sewing machine motor 56, and the FDD 32 are connected to respective interface devices such as driver circuits, which interface devices are further connected via buses to the CPU 41. The ROM 62, the RAM 63, and the communication section 70 are directly connected via buses to the CPU 61. The operation section 26, the LED 27, the buzzer 72, the LCD 28, and the back light 75 are connected via respective interface devices, which are connected via buses to the CPU 61.

Figure 5:
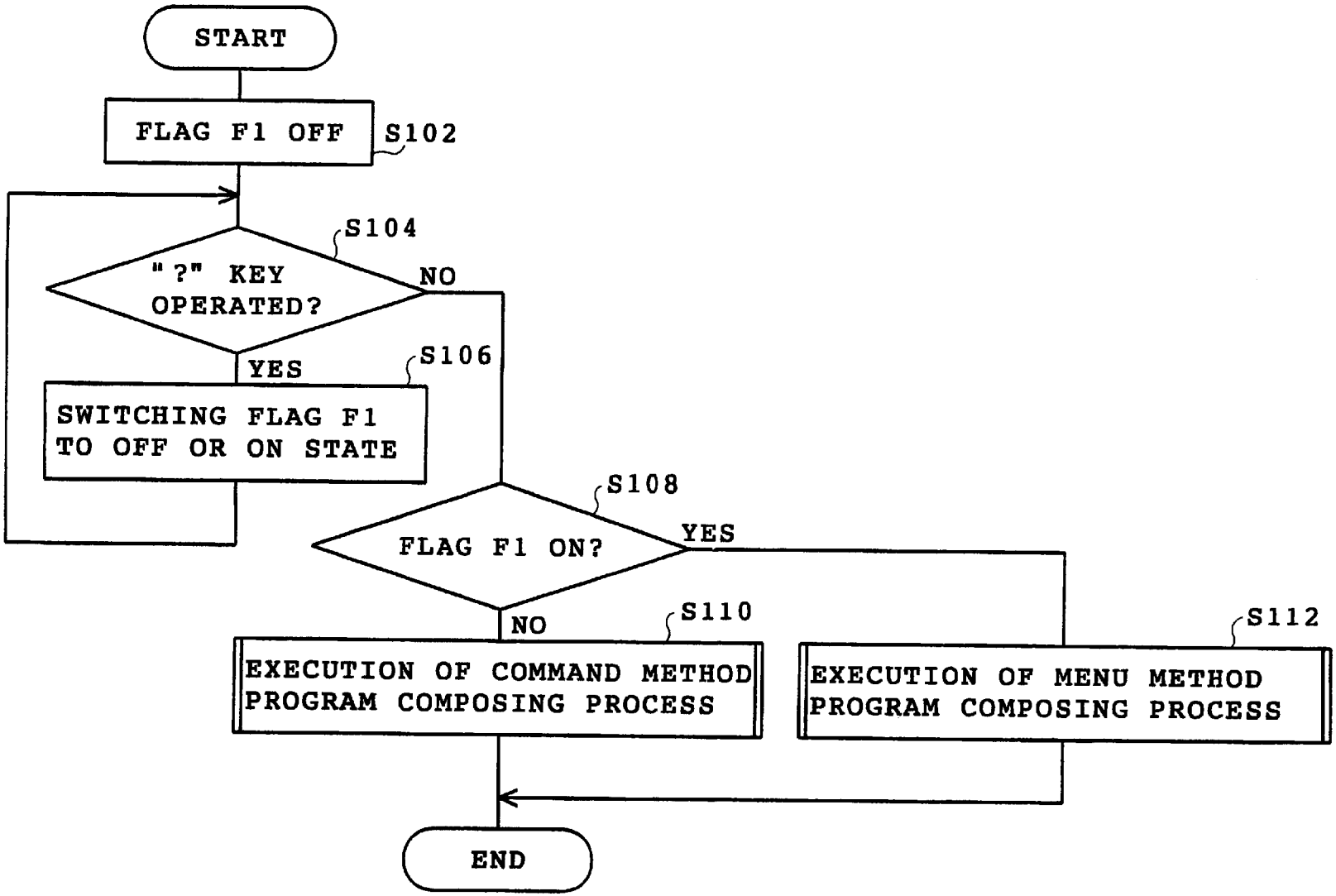
FIG. 5 is a flowchart showing a sewing program composing process.
Figure 6:
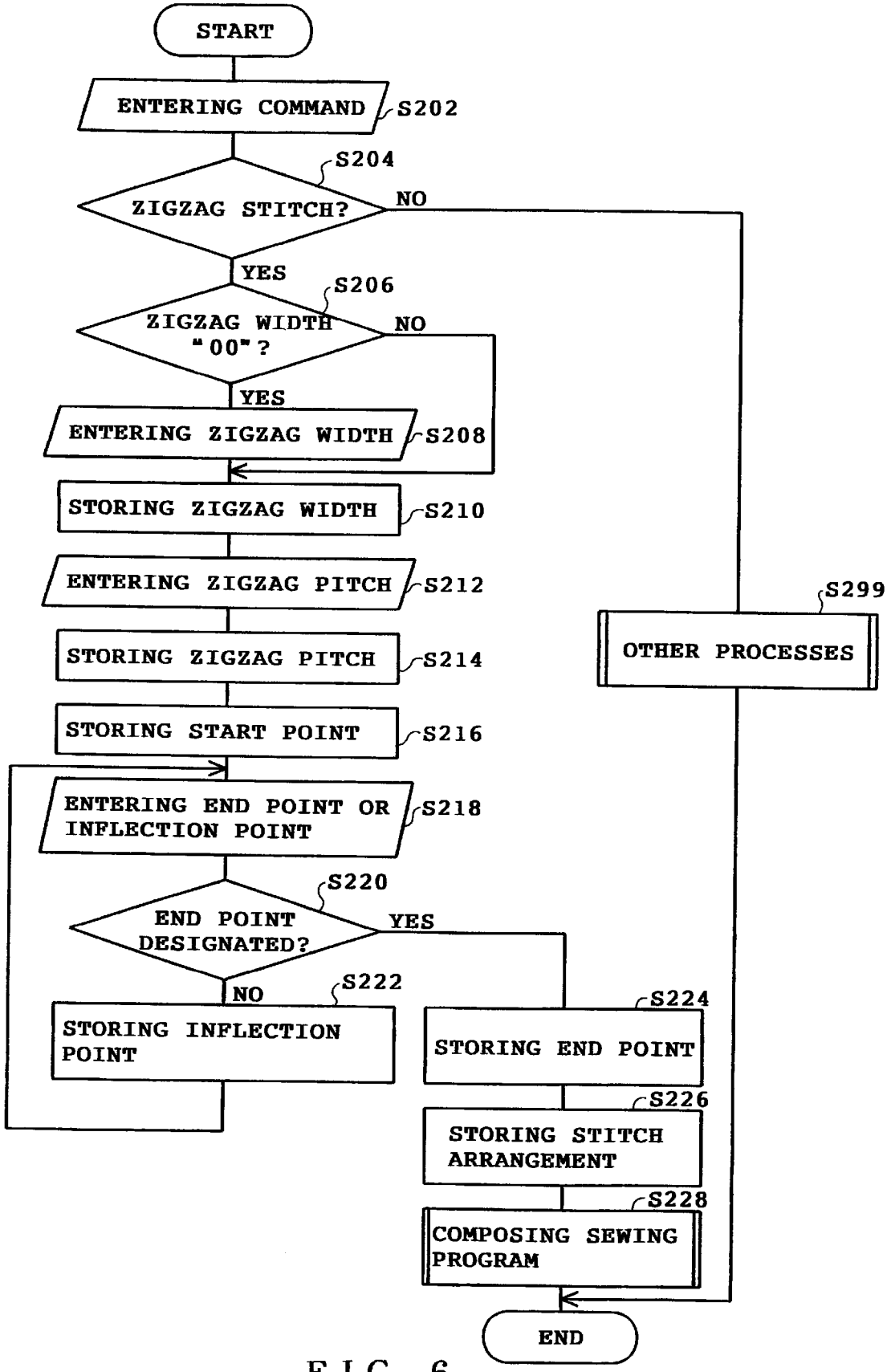
FIG. 6 is a flowchart showing a command method program composing process.
Figure 7:
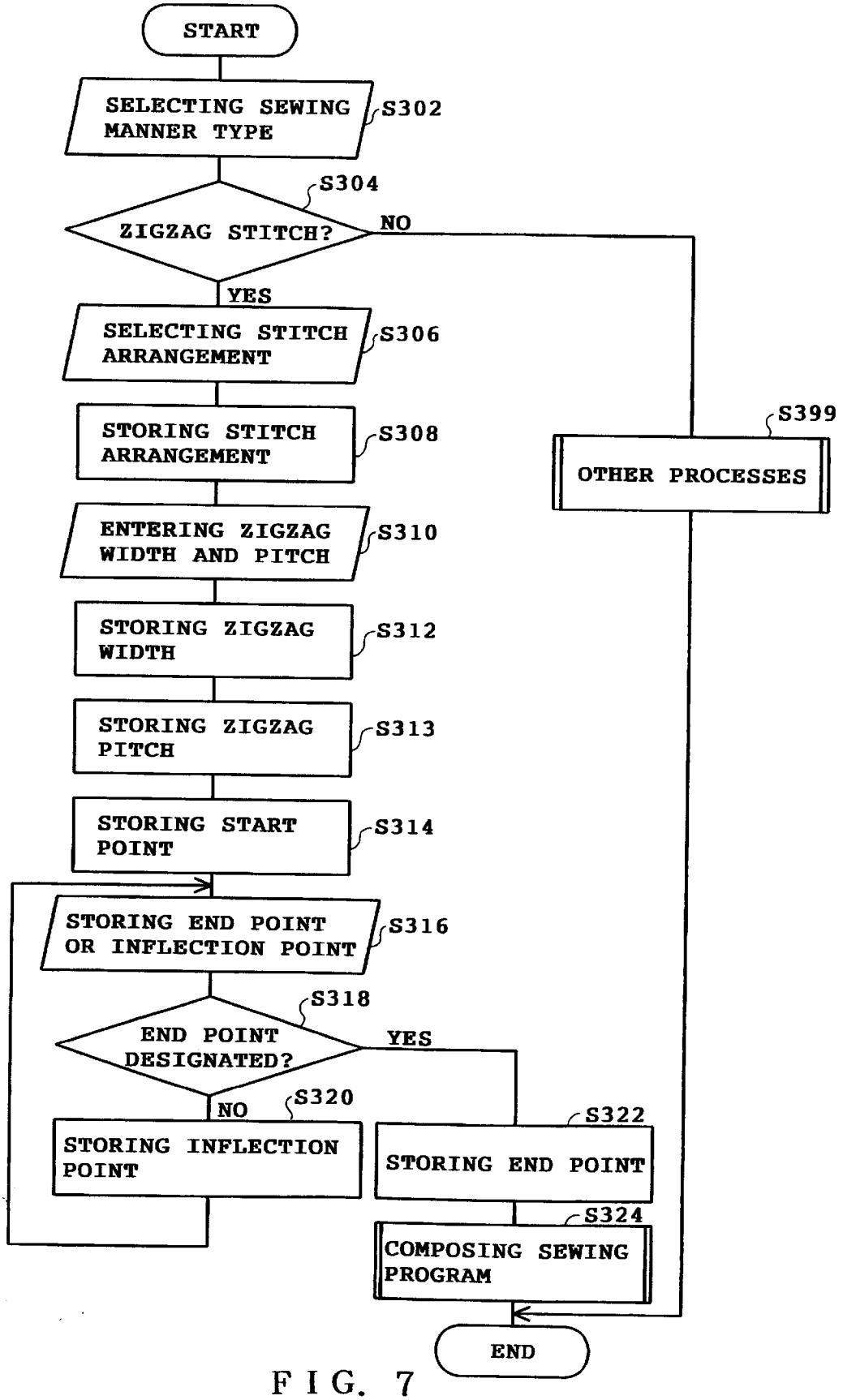
FIG. 7 is a flowchart showing a menu method program composing process.

The operation for composition of the sewing program in the sewing machine 1 will be described with reference to FIGS. 5 to 7. In the following description, the sewing program for execution of a zigzag stitch will be composed. FIGS. 5 to 7 illustrate the control contents of processes executed by the CPU 41 when the operating mode of the sewing machine 1 is switched to the sewing program composing mode by the user.

Upon start of the sewing program composing process, the CPU 41 resets or turns off an input method flag F1 (step S102). The input method flag F1 represents the composition of the sewing program either by a command method or by a menu method. When the flag F1 is reset or turned off, the sewing program composition is executed by the command method. When the flag F1 is set or turned on, the sewing program composition is executed by the menu method. The CPU 41 then determines whether the "?"key has been operated in the operation section 26 of the programmer 22 (step S104). When the "?" key has been operated (YES at step S104), the CPU 41 switches the input method flag Fl to the OFF or ON state (S106), thereby returning to step S104.

On the other hand, when the "?" key has not been operated (NO at step S104), the CPU 41 checks the input method flag F1 (step 5108). When the input method flag F1 has been reset (NO at step S108), the command method sewing program composing process is executed as will be described later (S110). On the other hand, when the input method flag F1 has been set (YES at step S108), the menu method program composing process is executed as will be described later (step S112).

The CPU 41 is on standby for input of a command (step S202) when having moved to the command method program composing process at step S110, as shown in FIG. 6. The user can enter a predetermined command in this state. For example, when the zigzag stitch is to be executed, the user enters a zigzag stitch command, "7**M" where each symbol * is a numeral from 0 to 9. The number of two figures designated by "**" represents a zigzag width in the unit of 0.1 mm. For example, "755M" represents the zigzag width of 5.5 mm.

When the command has been entered at step S202, the CPU 41 determines whether the command is the above-mentioned zigzag stitch command (step S204). The CPU 41 then determines whether the designated zigzag width is "00" (step S206) when the entered command represents the zigzag stitch (YES at step S204). When the zigzag width is "00" (YES at step S206), the CPU 41 is on standby for re-entrance of the zigzag width (step S208). Then, the user can enter a command, "***M" where each symbol * is a numeral from 0 to 9. The number of three figures represents the zigzag width. For example, a command, "155M," represents the zigzag width of 5.5 mm.

The zigzag width can directly be designated in the zigzag stitch command when represented by the number of two figures. As a result, the zigzag width can quickly be entered. Even when the zigzag stitch is represented by the numeral of three figures, the zigzag width can be entered at step S208 as described above. The zigzag width may be designated by the numeral of three figures in the zigzag stitch composition command. In this case, however, the numeral of three figures need to be entered when the zigzag width is designated by the numeral of two figures as well as by the numeral of three figures. Accordingly, the zigzag width can quickly be entered in the manner as employed in the embodiment when the designation by the numeral of two figures suffices in most cases.

The numerical value is stored as the data of the zigzag width in a memory (step S210) when the numeral of two figures has been entered in the zigzag stitch command or when the numeral of three figures has been entered at step S208. The CPU 41 is then on standby for the entrance of a zigzag pitch (step S212). The user can enter a zigzag pitch command, "***M" where each symbol * is a numeral from 0 to 9. The number of three figures designated by "*" represents a zigzag pitch which is a unit length of repeated zigzag stitches. For example, "025M" is entered when the zigzag pitch is 2.5 mm. When the numerical value has been entered at step S212, it is stored as the data of the zigzag pitch in the memory (step S214**).

The current location on the cloth C beneath the needle 18 is stored as data of a sewing start point (coordinate values) in the memory (step S216). Thereafter, the CPU 41 is on standby for the designation of an inflection point or a sewing end point (step S218). In this case, the cloth presser 8 can actually be moved forward, rearward, leftward and rightward when the user operates four arrow keys of the programmer 22. The cloth presser 8 is moved to a desired location and an L key is then operated so that the current location beneath the needle 18 can be designated as the inflection point. Furthermore, when "78*L" where symbol * is a numeral from 7 to 9 is entered as a command designating the sewing end point, a current location beneath the needle 8 is designated as the sewing end point. A stitch arrangement is determined depending upon the numeral designated for the symbol *. For example, the command, "789L," is entered, the zigzag stitch is parted uniformly right and left about a reference line which is a curve passing through the designated inflection point. The zigzag stitch is formed on the left of the reference line when the command, "788L," is entered. The zigzag stitch is formed on the right of the reference line when the command, "787L," is entered.

The CPU 41 then determines whether the sewing end point has been designated or entered (step S220). The current location beneath the needle 18 is stored as the data of the inflection point in the memory (S222) when the sewing end point has not been entered (NO at step S220). The CPU 41 then returns to step S218. On the other hand, when the sewing end point has been entered (YES at step S220), the current location beneath the needle 18 is stored as the data of the sewing end point in the memory (S224) and the designated stitch arrangement is stored in the memory (S226).

Based on the conditions designated in the above-described processes, the CPU 41 composes a sewing program required for execution of the zigzag stitch (S228). The processes for composing the sewing program are well known in the art of the sewing machines of the above-described type and do not constitute the subject matter of the invention. Accordlingly, the description of the composition of the, sewing program is eliminated.

When the entered command is not the zigzag stitch command (NO at step S204), the CPU 41 advances to other processes (S299). The other processes include a process for determining whether the entered command is another command, a process executed when the entered command is another command, a process for error when the command has erroneously been entered, a process for interruption when the entered command is an interruption command. These processes are also well known in the art and do not constitute the subject matter of the invention. Accordingly, the description of these processes is eliminated.

The above-described command method program composing process is adapted to be the same as those in an old model of the programmable electronic sewing machine. As a result, the user accustomed to the old model of the programmable electronic sewing machine can quickly compose the sewing program by the command method program composing process. The command method program composing process constitutes one type of operating procedure in the invention.

Figure 4:
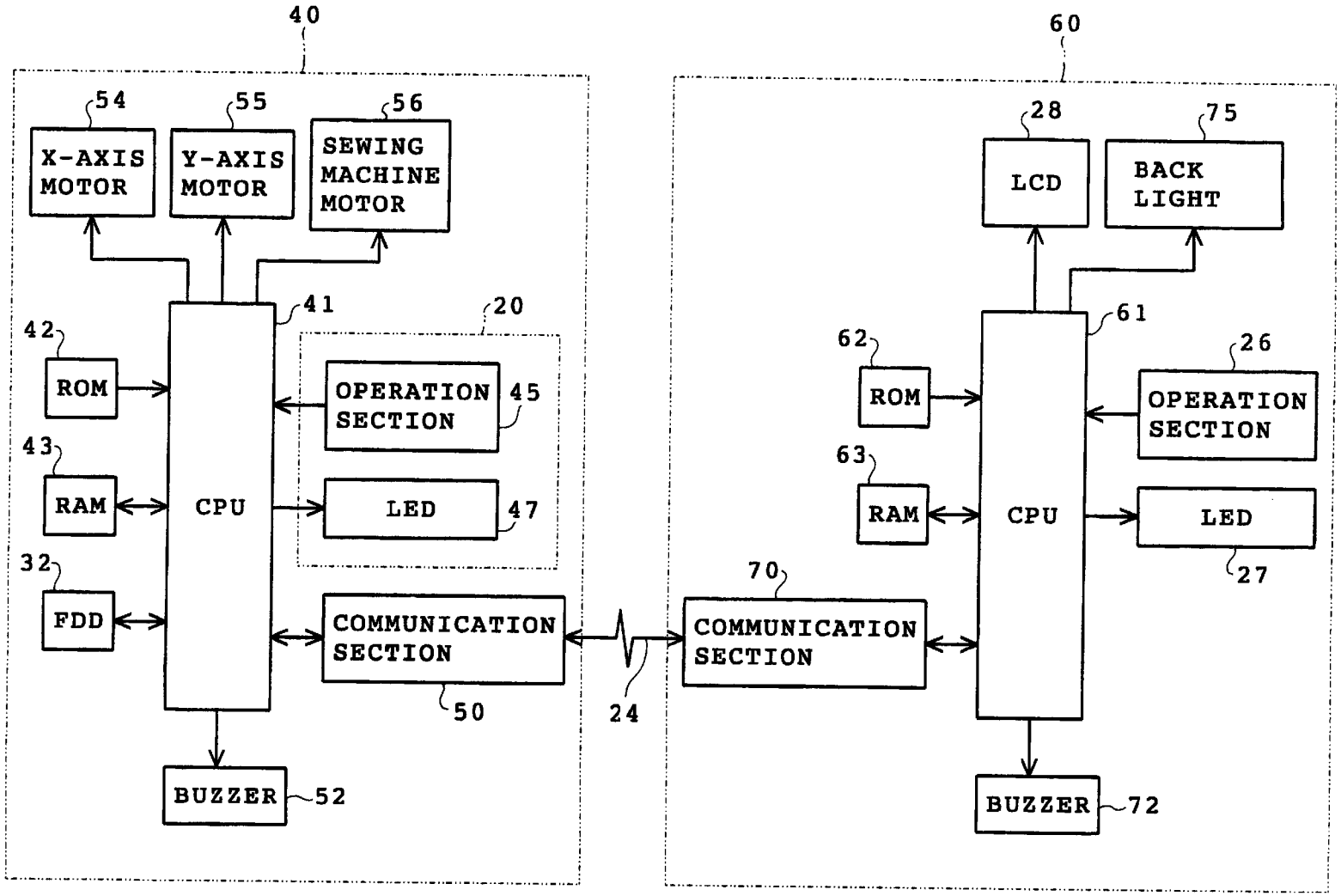
FIG. 4 is a block diagram of a control system of the sewing machine.
Figure 8A:
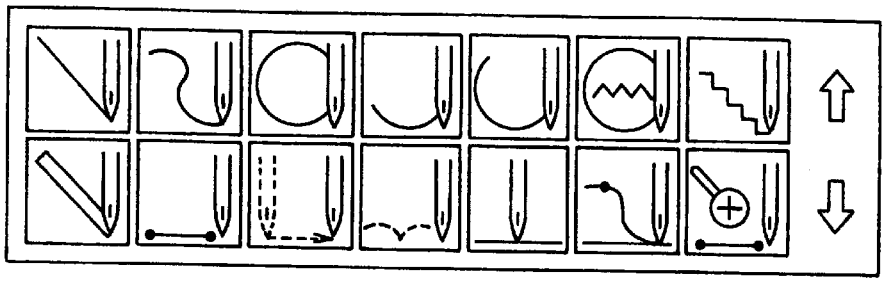
FIGS. 8A to 8D show display modes of an LCD during the menu method program composing process.

On the other hand, when advancing to the menu method program composing process at step S112 in FIG. 4, the CPU 41 is on standby f or the selection of a type of sewing manner as shown in FIG. 7 (step S302). The LCD 28 displays fourteen marks representative of types of sewing manners, as shown in FIG. 8A. One of the fourteen marks is in an inverted display mode. When the user operates the arrow keys, the mark in the inverted display mode is changed from one to another. The mark in the inverted display mode is selected when an ENTER key which is located over a "9" key in FIG. 3 is operated. For example, when the zigzag stitch is to be formed, the arrow keys are operated so that a zigzag stitch key which is a right-hand end key in an upper row of marks in FIG. 8A is displayed in the inverted mode, and the ENTER key is then operated.

Figure 8B:
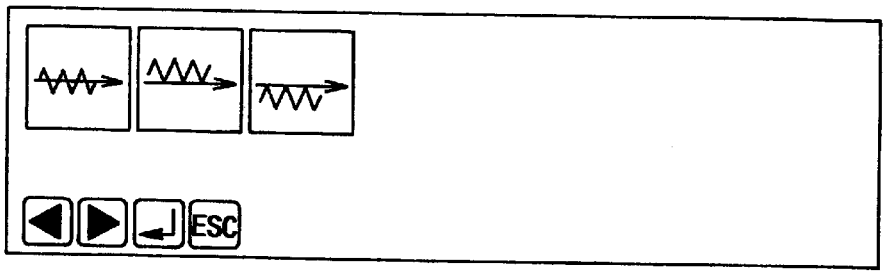

When one of the marks has been selected at step S302, the CPU 41 determines whether the mark is the above-mentioned zigzag stitch mark (step S304). The CPU 41 is on standby for selection of the stitch arrangement (step S306) when the selected mark is the zigzag stitch mark (YES at step S304). The LCD 28 then displays three marks representative of the respective stitch arrangements as shown in FIG. 8B. One of the marks is in the inverted display mode. When the user operates the arrow keys, the mark in the inverted display mode is changed from one to another. The mark in the inverted display mode is selected when the ENTER key is operated. One of the same three stitch arrangements as those in the command method program composing process can be selected in the menu method program composing process.

Figure 8C:
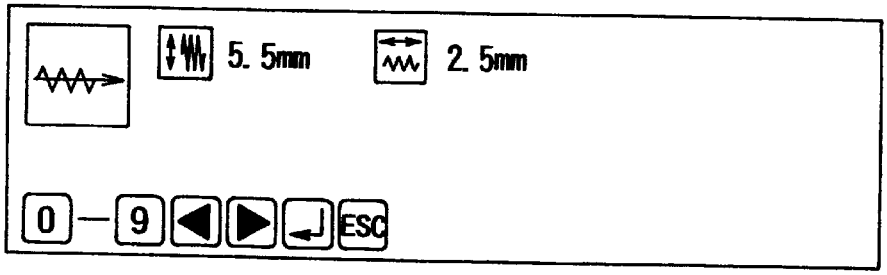

Data of the selected stitch arrangement is stored in the memory (step S308) when one of the marks has been selected at step S306. The CPU 41 is then on standby for the entrance of a zigzag width and a zigzag pitch (step S310). The LCD 28 displays columns for entrance of the zigzag width and the zigzag pitch as shown in FIG. 8C. The user can enter numeric values when operating the numeric eys. When the ENTER key is then operated, the entered numeric values are set as the zigzag width and the zigzag pitch. Thus, at sted S310, the entered numeric values are stored as the zigzag width and the zigzag pitch in the memory (steps S312 and S313).

Figure 8D:
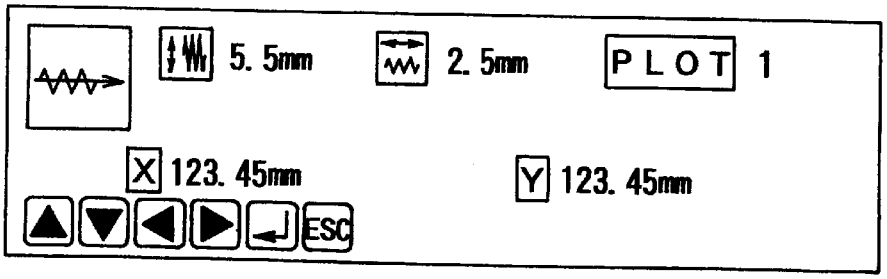

The current location on the cloth C beneath the needle 18 is stored as data of a sewing start point (coordinate values) in the memory (step S314). Thereafter, the CPU 41 is on standby for the designation of an inflection point or a sewing end point (step S316). The LCD 28 displays information such as the coordinates of the current location beneath the needle 18 as shown in FIG. 8D. The cloth presser 8 can actually be moved forward, rearward, leftward and rightward when the user operates the arrow keys. The current location beneath the needle 18 is designated as the inflection point when the ENTER key is operated once after movement of the cloth presser 8. Furthermore, when the ENTER key is operated continuously twice after movement of the cloth presser 8, the current location beneath the needle 18 is designated as the sewing end point.

The CPU 41 then determines whether the sewing end point has been designated (step S318). The current location beneath the needle 18 is stored as the data of the inflection point in the memory (S320) when the sewing end point has not been designated (NO at step S318). The CPU 41 then returns to step S316. On the other hand, when the ewing end point has been entered (YES at step S318), the urrent location beneath the needle 18 is stored as the data of the sewing end point in the memory (S322). Based an the conditions designated in the above-described processes, the CPU 41 composes a sewing program reqiired for execution of the zigzag stitch (S324). Since the processes for composing the sewing program are well known in the art of the sewing machines as described above, the description of the composition of the sewing program is eliminated.

When the entered command is not the zigzag stitch command (NO at step S304), the CPU 41 advances to other processes (S399). The other processes include a process for determining whether the entered command is another command, processes executed when the entered command is another command, a process for error when the command has erroneously been entered, and a process for interruption when the entered command is an interruption command, as described above. Since these processes are also well known in the art and do not constitute the subject matter of the invention, the description of these processes is eliminated.

According to the above-described sewing machine 1, the user can select either the command method program composing process or the menu method program composing process. The required data are entered in the operating procedure. The same sewing program is composed on the basis of the entered conditions even in the command or menu method program composing process. Consequently, either operating manner more convenient to the user can be selected when the sewing program is composed.

Particularly, the command method program composing process is the same as that employed in the old model of the sewing machine. Consequently, the user of the old model car readily operate the new model of the sewing machine. On the other hand, the figures are displayed as the selectable items an the screen of the LCD 28 in the menu method program composing process. Viewing the displayed figures, the user can understand the contents of the items. Consequently, even a beginner can smoothly carry out the selection.

In a modified form, one of two or more command method program composing processes having different command systems may be selectable. In this arrangement, too, the data can be entered in different two or more operating procedures. The same sewing program can be composed an the basis of the data entered in these operating procedures. Furthermore, one of two or more menu method program composing processes having different figure display systems or different operating systems may be selectable. In this arrangement, too, the data can be entered in different two or more operating procedures. The same sewing program can be composed on the basis of the data entered in these operating procedures. Additionally, one of two or more command and menu method program composing processes may be selectable.

The programmer 22 serves as the input means and the control system 40 at the machine body side serves as the sewing program composing means in the foregoing embodiment. However, the programmer 22 may serve both as the input means and as the sewing program composing means, instead. In this arrangement, the sewing program composed by the programmer 22 is transferred to the control system 40. Furthermore, the operation panel 20 may serve as the input means instead of the programmer 22. Additionally, an operation panel serving as the input means may be provided on the bed 5 or the arm 6.

The body of the sewing machine 1 is provided with the sewing program composing function in the foregoing embodiment. However, the invention may be applied to an apparatus having the sewing program composing function but no sewing function. For example, the invention may be applied to a computer system, e.g., personal computers, having no sewing function.

When the invention constitutes a dedicated sewing program composing device in use of the computer system as described above, the device preferably comprises a ROM etc. for recording a program for processing the composition of sewing program. Furthermore, a general purpose computer system comprising a personal computer may function as the sewing program composing device only when necessary. In this case, the program for processing the composition of sewing program is preferably stored in a recording medium such as a flexible disk, a CDROM, or an IC card. Furthermore, the program for processing the composition of sewing program is stored in the ROMs 42 and 62 of the control systems 40 and 60 respectively in the foregoing embodiment. However, the sewing machine 1 may be provided with a reader for reading the program stored in the flexible disk, the CDROM or the IC card, so that the program is entered into the sewing machine 1 via the recording medium. In this arrangement, a flush memory or hard disk system is preferably provided in the sewing machine for storing the program.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A programmable electronic sewing machine comprising:

input means for supplying input data when operated by a user;

displaying means for display; and sewing program composing means for composing a sewing program for the sewing machine on the basis of the input data supplied from the input means, the sewing program composing means including command method program composing means for composing the sewing program on the basis of a command when the command is supplied thereto from the input means, the command being constituted by characters arranged according to a predetermined rule, and menu method program composing means for composing the sewing program on the basis of a series of selected one or more optionally selectable items displayed on a screen of the displaying means, the sewing program composing means composing the same sewing program on the basis of the input data supplied from the input means when the command method program composing means and the menu method program composing means are operated.

2. A sewing machine according to claim 1, wherein the menu method program composing means operates the displaying means so that patterns representative of the selectable items are displayed on the screen of the displaying means.

3. A sewing machine according to claim 1, which further comprises a sewing machine body and an operation panel provided on the sewing machine body and including a number of keys, and wherein the input means comprises the operation panel.

4. A sewing machine according to claim 1, which further comprises a sewing machine body and a portable operation box detachably attached to the sewing machine body and including a number of keys, and wherein the input means comprises the operation box.

5. A sewing machine according to claim 4, wherein the operation box functions as the sewing program composing means.

6. A sewing program composing device comprising:

input means for supplying input data when operated by a user;

displaying means for display; and sewing program composing means for composing a sewing program for a programmable electronic sewing machine on the basis of the input data supplied from the input means, the sewing program composing means including command method program composing means for composing the sewing program on the basis of a command when the command is supplied thereto from the input means, the command being constituted by characters arranged according to a predetermined rule, and menu method program composing means for composing the sewing program on the basis of a series of selected one or more optionally selectable items displayed on a screen of the displaying means, the sewing program composing means composing the same sewing program on the basis of the input data supplied from the input means when the command method program composing means and the menu method program composing means are operated.

7. A sewing program composing device according to claim 6, wherein the menu method program composing means operates the displaying means so that patterns representative of the selectable items are displayed an the screen of the displaying means.

8. A sewing program composing device according to claim 6, which further comprises a sewing machine body and an operation panel provided on the sewing machine body and including a number of keys, and wherein the input means comprises the operation panel.

9. A sewing program composing device according to claim 6, which further comprises a sewing machine body and a portable operation box detachably attached to the sewing machine body and including a number of keys, and wherein the input means comprises the operation box.

10. A sewing program composing device according to claim 9, wherein the operation box functions as the sewing program composing means.

11. A storage medium for storing a program for operating a programmable electronic sewing machine or a sewing program composing device, the program accomplishing the functions of:

input means for supplying input data when operated by a user;

displaying means for display; and sewing program composing means for composing a sewing program for a programmable electronic sewing machine on the basis of the input data supplied from the input means, the sewing program composing means including command method program composing means for composing the sewing program on the basis of a command when the command is supplied thereto from the input means, the command being constituted by characters arranged according to a predetermined rule, and menu method program composing means for composing the sewing program on the basis of a series of selected one or more optionally selectable items displayed on a screen of the displaying means, the sewing program composing means composing the same sewing program on the basis of the input data supplied from the input means when the command method program composing means and the menu method program composing means are operated.

12. A storage medium according to claim 11, wherein the menu method program composing means operates the displaying means so that patterns representative of the selectable items are displayed on the screen of the displaying means.

13. A storage medium according to claim 11, wherein the input means comprises an operation panel provided on a sewing machine body and including a number of keys.

14. A storage medium according to claim 11, wherein the input means comprises a portable operation box detachably attached to a sewing machine body and including a number of keys.

15. A storage medium according to claim 14, wherein the operation box functions as the sewing program composing means.

* * * * *